US009886882B2

(12) United States Patent
He et al.

(10) Patent No.: US 9,886,882 B2
(45) Date of Patent: Feb. 6, 2018

(54) GRAYSCALE COMPENSATION METHOD

(71) Applicant: SHENZHEN CHINA STAR OPTOELECTRONICS TECHNOLOGY CO. LTD., Guangdong (CN)

(72) Inventors: Tao He, Guangdong (CN); Yuyeh Chen, Guangdong (CN); Jianjun Xie, Guangdong (CN)

(73) Assignee: SHENZHEN CHINA STAR OPTOELECTRONICS TECHNOLOGY CO. LTD., Guangdong (CN)

( * ) Notice: Subject to any disclaimer, the term of this patent is extended or adjusted under 35 U.S.C. 154(b) by 117 days.

(21) Appl. No.: 14/772,387

(22) PCT Filed: May 25, 2015

(86) PCT No.: PCT/CN2015/079690

§ 371 (c)(1),
(2) Date: Sep. 3, 2015

(87) PCT Pub. No.: WO2016/183859

PCT Pub. Date: Nov. 24, 2016

(65) Prior Publication Data

US 2016/0343283 A1 Nov. 24, 2016

(30) Foreign Application Priority Data

May 19, 2015 (CN) ..... 2015 1 0256693

(51) Int. Cl.
*G09G 3/20* (2006.01)

(52) U.S. Cl.
CPC ..... *G09G 3/2003* (2013.01); *G09G 3/2051* (2013.01); *G09G 2300/0452* (2013.01); *G09G 2320/0242* (2013.01); *G09G 2320/0666* (2013.01)

(58) Field of Classification Search
CPC ..... G09G 3/20; G09G 3/36; G09G 3/3607; G09G 3/364; G09G 5/02; H04N 1/6008
See application file for complete search history.

(56) References Cited

U.S. PATENT DOCUMENTS

2004/0222999 A1 11/2004 Choi
2007/0024772 A1 2/2007 Childers
(Continued)

FOREIGN PATENT DOCUMENTS

CN 1551707 A 12/2004
CN 103106860 A 5/2013
(Continued)

*Primary Examiner* — Antonio A Caschera
(74) *Attorney, Agent, or Firm* — Mark M. Friedman

(57) ABSTRACT

The present invention provides a grayscale compensation method, the method includes converting raw image data into a first image data; obtaining a second image data which can be displayed on the display panel according to the first image data in a preset manner, and the second image data for each pixel includes 3-color grayscale data among a red, a green, a blue, and a white grayscale data of the first image data; performing a grayscale compensation on the grayscale data of the second image data according to the first image data and a predetermined rule.

14 Claims, 5 Drawing Sheets

(56) References Cited

U.S. PATENT DOCUMENTS

| | | | | |
|---|---|---|---|---|
| 2007/0159492 | A1* | 7/2007 | Lo | G09G 5/026 345/589 |
| 2008/0231577 | A1 | 9/2008 | Lin et al. | |
| 2013/0120472 | A1 | 5/2013 | Byun et al. | |
| 2016/0086530 | A1 | 3/2016 | Chen et al. | |

FOREIGN PATENT DOCUMENTS

| | | | |
|---|---|---|---|
| CN | 104505052 | A | 4/2015 |
| TW | 200839698 | A | 10/2008 |

* cited by examiner

GRAYSCALE COMPENSATION METHOD

BACKGROUND OF THE INVENTION

Field of the Invention

The present invention relates to a field of monitor technology, and more particularly to a grayscale compensation method.

Description of Prior Art

FIG. 1 illustrates an arrangement of pixel units on a display panel. The display panel 10 includes a plurality of pixel units 11, in conjunction with FIG. 2, and each pixel unit 11 includes a red sub-pixel 13, a green sub-pixel 14, a blue sub-pixel 15, and a white sub-pixel 16. Only one arrangement is given in FIG. 1, certainly, and other arrangements are feasible but are not herein enumerated. There are additional white sub-pixels arranged on the whole display panel in FIG. 1. In a panel, such an arrangement of pixel units having additional white sub-pixels raises transmissivity of a backlight, and therefore a luminance of a white pixel image also is increased. Since the contrast of the picture is heightened, the luminance of the backlight can be reduced, thereby reducing power consumption of the backlight.

When a panel having the arrangement of pixel units of FIG. 1 is analyzed, it is found that since each image data inputted to each pixel of the display panel is generally described by a grayscale data corresponding to three colors, in order not to change a resolution of a panel, there are blue (B), green (G), and red (R) grayscale data within three pixels replaced by white (W) grayscale data for every four consecutive pixels 21-24 (arrangement such as GBW, RGB, WRG, BWR) as shown in FIG. 2, which illustrates the arrangement of pixel units in a row. The pixel having a white grayscale data W can achieve satisfactory results when the panel displays, for example, landscape pictures, but a phenomenon such as a color edge, an edge blurring, or even an error, is common to be found when black texts are displayed under a white background. Although this above phenomenon can be alleviated to some degree by using a nine-point filter, the display performance is still poor. Apart from that, two line buffers are required to be used in implementation of hardware so that a cost of hardware is increased.

Thus, there is a need for providing a grayscale compensation method to solve the existing problem of the prior art.

SUMMARY OF THE INVENTION

The objective of the present invention is to provide a grayscale compensation method for solving a technical problem in the prior art in which a phenomenon such as a color edge in texts, an edge blurring, or even an error, is commonly occurred when an image data is directly inputted to a display panel having a white sub-pixel.

To solve the foregoing problems, the present invention provides a grayscale compensation method which comprises:

converting raw image data into a first image data, the raw image data for each pixel including a raw red grayscale data, a raw green grayscale data, and a raw blue grayscale data, the first image data for each pixel including a first red grayscale data, a first green grayscale data, a first blue grayscale data, and a first white grayscale data;

obtaining a second image data which can be displayed on the display panel according to the first image data in a preset manner, the second image data for each pixel including 3-color grayscale data among a red, a green, a blue, and a white grayscale data of the first image data;

obtaining a third image data by performing grayscale compensation on the second image data based on the first image data and a predetermined rule, wherein the third image data for each pixel includes 3-color grayscale data among a second red grayscale data, a green grayscale data, a second blue grayscale data, and a second white grayscale data;

comparing the third image data with the first image data for each pixel to obtain a missing color data in the third image data for each pixel;

obtaining a missing grayscale data for a pixel based on the first image data of the pixel and the missing color data for the pixel, wherein the missing grayscale data represents the grayscale data of the missing color in the third image data of the pixels; and performing a grayscale sharing on a compensatory grayscale data in an adjoining pixel according to the missing grayscale data for the pixel, wherein the compensatory grayscale represents a grayscale data of a corresponding color with the missing grayscale data;

wherein the step of performing grayscale compensation on the second image data based on the first image data and the predetermined rule further comprises:

determining whether the second image data of the pixels includes a white grayscale data;

performing the grayscale compensation on the second image data of the pixels by using a first predetermined rule when the second image data of the pixels contain the white grayscale data;

performing the grayscale compensation on the second image data of the pixels by using a second predetermined rule when the second image data of the pixels do not contain the white grayscale data.

In the above grayscale compensation method of the present invention, when the second image data of the pixels contain a white grayscale data, if a first difference value is greater than a second difference value and the first white grayscale data is greater than a preset grayscale value, then the first predetermined rule is performing the grayscale compensation on the second image data of the pixels based on a first white grayscale data;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of the pixels.

In the above grayscale compensation method of the present invention, when the second image data of the pixels contain a white grayscale data, if a first difference value is less than a second difference value and the first white grayscale data is greater than a preset grayscale value, then the first predetermined rule is performing the grayscale compensation on the second image data of the pixels based on a first white grayscale data;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of the pixels.

In the above grayscale compensation method of the present invention, when the second image data of the pixels contain a white grayscale data, if a first difference value is less than a second difference value and the first white grayscale data is less than or equal to a preset grayscale value, then the first predetermined rule is performing the grayscale compensation on the second image data of the pixels based on a first setting value;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of the pixels.

In the above grayscale compensation method of the present invention, when the second image data of the pixels do not contain a white grayscale data, if a third difference value is greater than a first difference value and the second setting value is greater than a preset grayscale value, then the second predetermined rule is performing the grayscale compensation on the second image data of the pixels based on a second setting value;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of the pixels.

In the above grayscale compensation method of the present invention, when the second image data of the pixels do not contain a white grayscale data, if a third difference value is less than a first difference value and the second setting value is less than or equal to a preset grayscale value, then the second predetermined rule is that performing the grayscale compensation on the second image data of the pixels based on a second setting value;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of the pixels.

In the above grayscale compensation method of the present invention, when the second image data of the pixels do not contain a white grayscale data, if a third difference value is greater than a first difference value and the second setting value is less than or equal to a preset grayscale value, then the second predetermined rule is performing the grayscale compensation on the second image data of the pixels based on a second setting value;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of the pixels.

In the above grayscale compensation method of the present invention, the display panel comprises a plurality of pixel units, the pixel unit includes a red sub-pixel, a green sub-pixel, a blue sub-pixel, and a white sub-pixel.

To solve the foregoing problems, the present invention provides a grayscale compensation method comprising:

converting raw image data into a first image data, the raw image data for each pixel including a raw red grayscale data, a raw green grayscale data, and a raw blue grayscale data, the first image data for each pixel including a first red grayscale data, a first green grayscale data, a first blue grayscale data, and a first white gray data;

obtaining a second image data which can be displayed on the display panel according to the first image data in a preset manner, the second image data for each pixel including 3-color grayscale data among a red, a green, a blue, and a white grayscale data of the first image data; and performing grayscale compensation on the second image data based on the first image data and a predetermined rule.

In the above grayscale compensation method of the present invention, the step of performing grayscale compensation on the second image data based on the first image data and the predetermined rule further comprises:

determining whether the second image data of the pixels includes a white grayscale data;

performing the grayscale compensation on the second image data of the pixels by using a first predetermined rule when the second image data of the pixels contain a white grayscale data;

performing the grayscale compensation on the second image data of the pixels by using a second predetermined rule when the second image data of the pixels do not contain a white grayscale data.

In the above grayscale compensation method of the present invention, when the second image data of the pixels contain a white grayscale data, if a first difference value is greater than a second difference value and the first white grayscale data is greater than a preset grayscale value, then the first predetermined rule is performing the grayscale compensation on the second image data of the pixels based on a first white grayscale data;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of the pixels.

In the above grayscale compensation method of the present invention, when the second image data of the pixels contain a white grayscale data, if a first difference value is less than a second difference value and the first white grayscale data is greater than a preset grayscale value, then the first predetermined rule is performing the grayscale compensation on the second image data of the pixels based on a first white grayscale data;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of the pixels.

In the above grayscale compensation method of the present invention, when the second image data of the pixels contain a white grayscale data, if a first difference value is less than a second difference value and the first white grayscale data is less than or equal to a preset grayscale value, then the first predetermined rule is performing the grayscale compensation on the second image data of the pixels based on a first setting value;

wherein the first difference value is an absolute value of a difference between the first white grayscale data and the preset grayscale value, the second difference value is an absolute value of a difference between a first setting value and the preset grayscale value;

wherein a first selling value is a minimum among the first red grayscale data, the first green grayscale data, and the first blue grayscale data of the pixels.

In the above grayscale compensation method of the present invention, when the second image data of the pixels do not contain a white grayscale data, if a third difference value is greater than a first difference value and the second setting value is greater than a preset grayscale value, then the second predetermined rule is performing the grayscale compensation on the second image data of the pixels based on a second setting value;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of the pixels.

In the above grayscale compensation method of the present invention, when the second image data of the pixels do not contain a white grayscale data, if a third difference value is less than a first difference value and the second setting value is less than or equal to a preset grayscale value, then the second predetermined rule is performing the grayscale compensation on the second image data of the pixels based on a second setting value;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of the pixels.

In the above grayscale compensation method of the present invention, when the second image data of the pixels do not contain a white grayscale data, if a third difference value is greater than a first difference value and the second setting value is less than or equal to a preset grayscale value, then the second predetermined rule is performing the grayscale compensation on the second image data of the pixels based on a second setting value;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of the pixels.

In the above grayscale compensation method of the present invention, the third image data are obtained after the grayscale compensation has been performed on the second image data based on the first image data and a predetermined rule, the third image data for each pixel includes three-color grayscale data among a second red grayscale data, a green grayscale data, a second blue grayscale data, and a second white grayscale data;

the method further comprising:

comparing the third image data with the first image data for each pixel to obtain a missing color data in the third image data for each pixel;

obtaining a missing grayscale data for a pixel based on the first image data of the pixel and the missing color data for the pixel;

performing a grayscale sharing on a compensatory grayscale data in an adjoining pixel according to the missing grayscale data for the pixel.

In the above grayscale compensation method of the present invention, the display panel comprises a plurality of pixel units, the pixel unit includes a red sub-pixel, a green sub-pixel, a blue sub-pixel, and a white sub-pixel.

The grayscale compensation method of the present invention can enhance the resolution, hue and saturation of an image and thereby further improve display performance by converting an input raw image data, following conversion to compensate the discarded pixels in a manner of using the grayscale data of the remaining pixels.

DETAILED DESCRIPTION OF THE INVENTION

The preferred embodiments of the present invention will be detailed below in combination with the accompanying drawings. Spatially relative terms herein mentioned, such as "above", "beneath", "front", "back", "left", "right", "inner", "outer", "lateral", and the like may be used to describe one element's relationship to another element(s) as illustrated in the figures. Therefore, the spatially relative terms are used to describe and understand the present invention, but not to limit the invention. The drawings are drawn schematically and the same reference numbers are used to indicate the same or similar components throughout the drawings.

Figure 1:
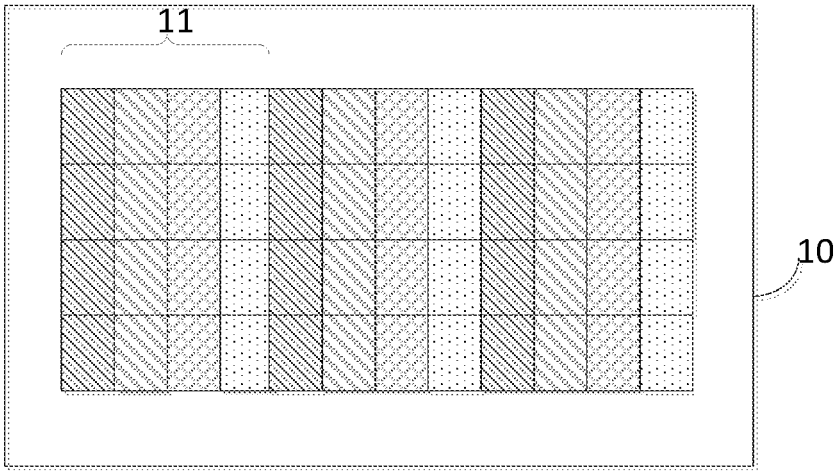
FIG. 1 is a schematic view showing an arrangement of pixel units on a display panel.
Figure 2:
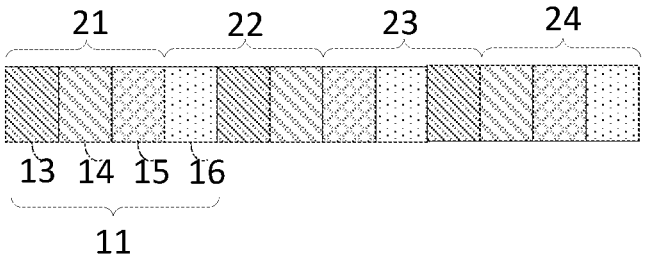
FIG. 2 is a schematic view showing the arrangement of pixel units in a row as illustrated in FIG. 1.
Figure 3:
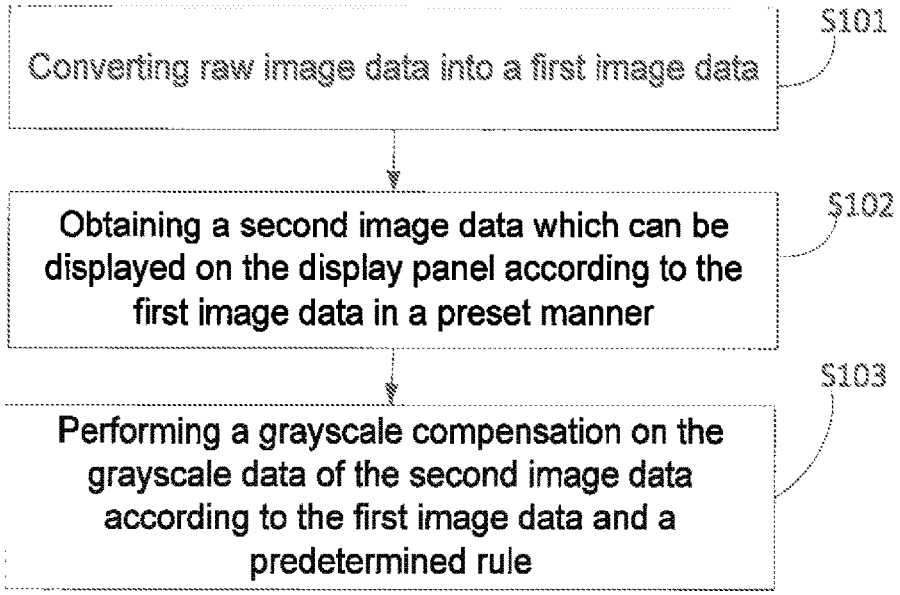
FIG. 3 is a flowchart showing a grayscale compensation method according to a first embodiment of the present invention.

Refer to FIG. 3, which is a flow chart showing a grayscale compensation method according to a first embodiment of the present invention.

As shown in FIG. 3, the grayscale compensation method of the present invention comprises steps of:

S101: Converting raw image data into a first image data.

Figure 4:
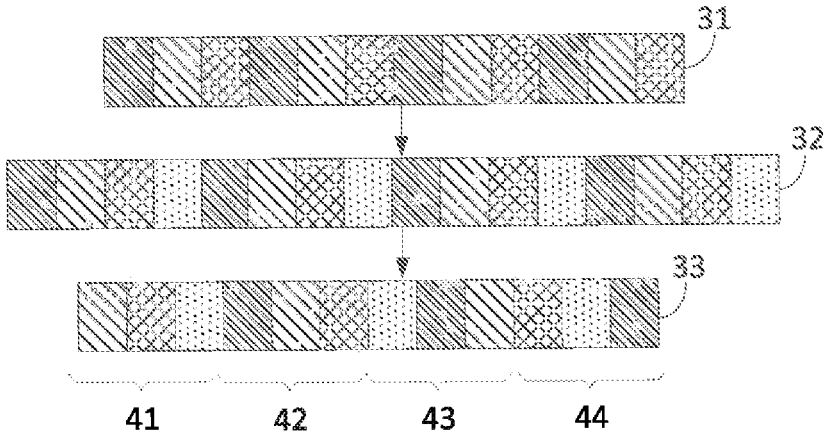
FIG. 4 is a schematic view of a variation of grayscale processed by the method as illustrated in FIG. 3.

The raw image data for each pixel include a raw red grayscale data, a raw green grayscale data, and a raw blue grayscale data. The data in a format of raw RGB is converted into a format of RGBW by means of HSV color enhancement algorithms, and grayscale data corresponding to a first image data is obtained after color correction processing. The grayscale data of the first image data for each pixel includes a first red grayscale data R', a first green grayscale data G', a first blue grayscale data B', and a first white gray data W'. As shown in FIG. 4, after the above conversion is performed, the number of pixels 31 before conversion in the horizontal direction is 4/3 of the number of pixels 32 after conversion. Consequently, a resolution of an LCD panel is changed, and the horizontal and vertical scaling for pixels will be varied such that the display performance of the LCD panel will be greatly affected.

S102: Obtaining a second image data which can be displayed on the display panel according to the first image data in a preset manner.

Generally, the second image data is obtained from the first image data in the preset manner. The first image data 32 follows a preset order to convert into the second image data 33. For example, the grayscale data of the first image data in the plurality of pixels 32 are arranged as GBWR, GBWR, GBWR, based on 3 grayscale data as a unit, a regrouping is performed according to an order of the arrangement of grayscale data for each color in the first grayscale image data to obtain the second image data 33. Accordingly, grayscale data of the second image data in a plurality of pixels 33 are arranged as GBW, RGB, WRG, BWR.

After the step S101 has been performed, the first image data cannot be normally displayed on the panel. Hence, a further conversion is required to allow them to be displayed properly on the panel. Since the number of the sub-pixels on the panel is equal to the number of grayscale data of raw image data, the image data of the input panel is still required to have a pixel for displaying an image grayscale data constituted by three-color grayscale data in order to maintain the resolution of the panel. As shown in FIG. 4, after the above conversion has been performed, the image data 33, i.e., the second image data for each pixel of pixels 41-44 corresponds to grayscale data of 3 colors among the red, green, blue, and white grayscale data of the first image data.

In such arrangement for pixels, the three-color grayscale data (respectively a blue grayscale data in the second pixel B'2, a green grayscale data in the third pixel G'3, and a red grayscale data in the fourth pixel R'4) for the raw image data of every four pixels are replaced by W (white) grayscale data, and therefore the color fidelity is sacrificed to some degree at the time of displaying an image, especially images which has a more obvious edge feature (such as text). As a result, a phenomenon such as a color edge or an edge blurring will inevitably appear, even an error will be shown, so that the viewing performance experienced by a user would be greatly influenced. Even if a nine point filter that is a general solution for improvement at the present time is adopted, it is unable to be effective improvement for this kind of phenomenon.

S103: Performing a grayscale compensation on the grayscale data of the second image data according to the first image data and a predetermined rule.

Even though the second image data can be displayed on the panel after the step S102 has been performed, it is necessary to perform a process of grayscale compensation due to a phenomenon such as a color edge or an edge blurring existing. Namely, gray scale data is obtained after a grayscale compensation has been performed in accordance with the predetermined rule of processing the first image data and the second image data in order to preserve the hue and saturation characteristics of the raw data.

The step specifically includes:

S201: Determining whether the second image data of the pixels includes a white grayscale data.

When the second image data of the pixels contain the white grayscale data, a step S202 is executed, and when the second image data of the pixels do not contain the white grayscale data, a step S203 is executed.

S202: Performing grayscale compensation on the second image data of the pixels by using a first predetermined rule when the second image data of the pixels contain a white grayscale data.

The first determined rule may be in the following manner:

S301: When the second image data of the pixels contain a white grayscale data, a grayscale compensation is performed on the second image data of the pixels based on a first white grayscale data if a first difference value is greater than a second difference value and the first white grayscale data is also greater than a preset grayscale value.

Where the first difference value is defined as an absolute value of a difference between the first white grayscale data and the preset grayscale value; the second difference value is defined as an absolute value of a difference between a first setting value and the preset grayscale value, in which the first setting value is a minimum among the first red grayscale data R', the first green grayscale data G', and the first blue grayscale data B' of the pixels.

Figure 5:
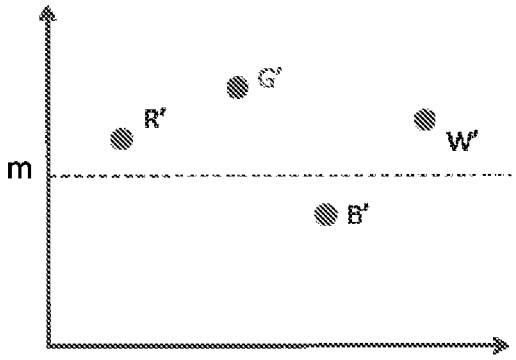
FIG. 5 is a distribution map of grayscale data according to a first exemplary pixel of the present invention.

As shown in FIG. 5, a distribution map of grayscale data is shown according to a first exemplary pixel of the present invention. The vertical axis represents gray level values, where m=127. If abs(W'−127) is greater than abs(gmin−127), where the "gmin" is equal to a first blue grayscale data, the RGB grayscale data of the raw image data are reflected to be higher so that the pixels of the entire screen image incline to be whiter and brighter. Since the pixels contain white grayscale data W which just can reflect the characteristics of the raw image data, it is necessary to focus on compensating the luminance. Consequently, the parameter, i.e. W', is taken as an energy transfer factor, and the grayscale data R', G', and B' are transferred to the grayscale data W' in light of a certain proportion to improve the display performance.

For example, when W'>127, and then abs(W'−127)>abs(gmin−127), a second image data of a pixel based on its first image data will be compensated according to the following equations:

$$R''=R'-W'*x1 \quad \text{equation 1}$$

$$G''=G'-W'*x1 \quad \text{equation 2}$$

$$B''=B'-W'*x1 \quad \text{equation 3}$$

$$W''=W'+W'*x1 \quad \text{equation 4}$$

where x1 is a predetermined proportional coefficient, R", G", B", W", respectively, represent a second red grayscale data, a second green grayscale data, a blue grayscale data, and a second white grayscale data included in the second image data of the pixel after the grayscale compensation has been performed.

The W' is the first white grayscale data; the preset grayscale value is taken as 127; the gmin is the first setting value; of course, the preset grayscale value may be another value; the preset grayscale value is taken a medium value of grayscale range for determining whether the grayscale drifts; R' is the first red grayscale data, G' is the first green grayscale data, and B' is the first blue grayscale data; R" is the second red grayscale data after the grayscale compensation has been performed, G" is the second green grayscale data after the grayscale compensation has been performed, B" is the second blue grayscale data after the grayscale compensation has been performed; equations 1-4 can be applied to all of the pixels which contain white grayscale data W.

S302: When the second image data of the pixels contain a white grayscale data, a grayscale compensation is performed on the second image data of the pixels based on the first white grayscale data if a first difference value is less than a second difference value and the first white grayscale data is greater than the preset grayscale value.

Where the first difference value is defined as an absolute value of a difference between the first white grayscale data and the preset grayscale value; the second difference value is defined as an absolute value of a difference between a first setting value and the preset grayscale value, in which the first setting value is a minimum among the first red grayscale data, the first green grayscale data, and the first blue grayscale data of the pixels.

When W'>127, and then abs(W'−127)<abs(gmin−127), the RGB grayscale data of the raw image data are reflected to be higher so that the pixels of the entire screen incline to be whiter and brighter. Since the pixels contain white grayscale data W which just can reflect the characteristics of the raw image data, it is necessary to focus on compensating the luminance. Consequently, W' data is taken as an energy transfer factor, and the grayscale data R', G', and B' are transferred to the grayscale data W' in light of a certain proportion to improve performance of the display.

For example, when W'>127 and then abs(W'−127)<abs(gmin−127), a second image data of a pixel based on its first image data will be compensated according to the following equations:

$$R''=R'-W'*x2 \quad \text{equation 5}$$

$$G''=G'-W'*x2 \quad \text{equation 6}$$

$$B''=B'-W'*x2 \quad \text{equation 7}$$

$$W''=W'+W'*x2 \quad \text{equation 8}$$

where x2 is a predetermined proportional coefficient, R", G", B", W", respectively, represent a second red grayscale data, a second green grayscale data, a blue grayscale data, and a second white grayscale data included in the second image data of the pixel after the grayscale compensation has been performed.

S303: When the second image data of the pixels contain a white grayscale data, a grayscale compensation is performed on the second image data of the pixels based on a first setting value if a first difference value is less than or equal to a second difference value and the first white grayscale data is less than the preset grayscale value.

Figure 6:
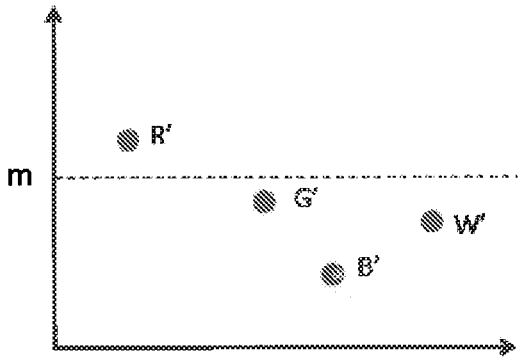
FIG. 6 is a distribution map of grayscale data according to a second exemplary pixel of the present invention.

FIG. 6 shows a distribution map of grayscale data according to a second exemplary pixel of the present invention. The vertical axis represents gray level values, where m=127. If abs(W'−127)<abs(gmin−127), where the gmin is equal to a first blue grayscale data, RGB grayscale data of the raw image data are reflected to be lower so that the proportion of white color in the pixels of the entire image inclines less and the white grayscale data W' after conversion has a lower value. Since the pixels contain white grayscale data, it is necessary to focus on compensating color saturation. Therefore, the gmin is taken as an energy transfer factor, and the grayscale data R', G', and B' are transferred to the grayscale data W' in light of a certain proportion to acquire a better display performance.

For example, when W'≤127, and then abs(W'−127)<abs(gmin−127), a second image data of a pixel based on its first image data will be compensated according to the following equations:

$$R''=R'-W'*x3 \quad \text{equation 9}$$

$$G''=G'-W'*x3 \quad \text{equation 10}$$

$$B''=B'-W'*x3 \quad \text{equation 11}$$

$$W''=W'+W'*x3 \quad \text{equation 12}$$

where x3 is a predetermined proportional coefficient, R", G", B", W", respectively, represent a second red grayscale data, a second green grayscale data, a blue grayscale data, and a second white grayscale data included in the second image data of the pixel after the grayscale compensation has been performed.

S203: Performing the grayscale compensation on the second image data of the pixels by using a second predetermined rule when the second image data of the pixels does not contain a white grayscale data.

The second determined rule may be in the following manner:

S401: When the second image data of the pixels do not contain a white grayscale data, a grayscale compensation is performed on the second image data of the pixels based on a second setting value if a third difference value is greater than a first difference value and a second white grayscale data is also greater than the preset grayscale value.

When the second setting value is greater than the preset gray level value, in accordance with the distribution rules of pixels, the third difference value is bound to be greater than the first difference value. The first difference value is defined as an absolute value of a difference between the first white grayscale data and the preset grayscale value. The third difference value is defined as an absolute value of a difference between a second setting value and the preset grayscale value, in which the second setting value is a maximum among the first red grayscale data, the first green grayscale data, and the first blue grayscale data of the pixels.

In conjunction with FIG. 5, when gmax>127, and then m=127 and abs (gmax−127)>abs(W'−127), the second setting value of gmax is equal to a green grayscale data. The RGB grayscale data of the raw image data are reflected to be higher so that the pixels of the entire screen image incline to be whiter and brighter. Since the pixels do not contain white grayscale data W, it is necessary to focus on chroma compensation so as to take gmax as an energy transfer factor. Consequently, the grayscale data W' is transferred to the grayscale data R', G', and B' in light of a certain proportion for improvement of display performance.

For example, when gmax>127, and then abs(gmax−127)>abs(W'−127), a second image data of a pixel based on its first image data will be compensated according to the following equations:

$$R''=R'+W'*x4 \quad \text{equation 13}$$

$$G''=G'+W'*x4 \quad \text{equation 14}$$

$$B''=B'+W'*x4 \quad \text{equation 15}$$

$$W''=W'-W'*x4 \quad \text{equation 16}$$

where x4 is a predetermined proportional coefficient, R", G", B", W", respectively, represent a second red grayscale data, a second green grayscale data, a blue grayscale data, and a second white grayscale data included in the second image data of the pixel after the grayscale compensation has been performed.

S402: When the second image data of the pixels do not contain a white grayscale data, a grayscale compensation is performed on the second image data of the pixels based on the first white grayscale data if a third difference value is less than a first difference value and a second setting value is less than or equal to the preset grayscale value.

Where the first difference value is defined as an absolute value of a difference between the first white grayscale data and the preset grayscale value; the third difference value is defined as an absolute value of a difference between a second setting value and the preset grayscale value, in which the second setting value is a maximum among the first red grayscale data, the first green grayscale data, and the first blue grayscale data of the pixels.

When gmax≤127, and then abs(gmax−127)<abs(W'−127), RGB grayscale data of the raw image data are reflected to be lower so that the luminance of the pixels in the entire screen image inclines to be lower. Since the pixels do not contain white grayscale data W, it is necessary to focus on compensating luminance. Therefore, the grayscale data W' taken as an energy transfer factor is transferred to the grayscale data R', G', and B' in light of a certain proportion for the improvement of display performance.

When gmax≤127, and then abs(gmax−127)<abs(W'−127), a second image data of a pixel based on its first image data will be compensated according to the following equations:

$$R''=R'+W'*x5 \quad \text{equation 17}$$

$$G''=G'+W'*x5 \quad \text{equation 18}$$

$$B''=B'+W'*x5 \quad \text{equation 19}$$

$$W''=W'-W'*x5 \quad \text{equation 20}$$

where x5 is a predetermined proportional coefficient, R", G", B", W", respectively, represent a second red grayscale data, a second green grayscale data, a blue grayscale data, and a second white grayscale data included in the second image data of the pixel after the grayscale compensation has been performed.

S403: When the second image data of the pixels do not contain a white grayscale data, a grayscale compensation is performed on the second image data of the pixels based on a first white grayscale data if the third difference value is greater than the first difference value and the second setting value is less than or equal to the preset grayscale value.

Where the first difference value is defined as an absolute value of a difference between the first white grayscale data and the preset grayscale value; the third difference value is defined as an absolute value of a difference between a second setting value and the preset grayscale value, in which the second setting value is a maximum among the first red grayscale data, the first green grayscale data, and the first blue grayscale data of the pixels.

When gmax≤127, and then abs(gmax−127)>abs(W'−127), the RGB grayscale data of the raw image data are reflected to be lower so that the luminance of the pixels in the entire screen image inclines to be lower. Since the pixels do not contain white grayscale data W, it is necessary to focus on compensating luminance. Therefore, the grayscale data W' taken as an energy transfer factor is transferred to the grayscale data R', G', and B' in light of a certain proportion for the improvement of display performance.

When gmax≤127, and then abs(gmax−127)<abs(W'−127), a second image data of a pixel based on its first image data will be compensated according to the following equations:

$$R''=R'+W'*x6 \quad \text{equation 21}$$

$$G''=G'+W'*x6 \quad \text{equation 22}$$

$$B''=B'+W'*x6 \quad \text{equation 23}$$

$$W''=W'-W'*x6 \quad \text{equation 24}$$

where x6 is a predetermined proportional coefficient, R", G", B", W", respectively, represent a second red grayscale data, a second green grayscale data, a blue grayscale data, and a second white grayscale data included in the second image data of the pixel after the grayscale compensation has been performed.

The grayscale compensation method of the present invention, following the conversion of the input raw image data, makes up for those discarded pixels due to conversion by using the grayscale data of the remaining pixels for compensation. As a result, a phenomenon such as a color edge in black texts, an edge blurring or even an error is avoided, and simultaneously the resolution, hue, and saturation of the image are ensured and the display performance is further improved.

Figure 7:
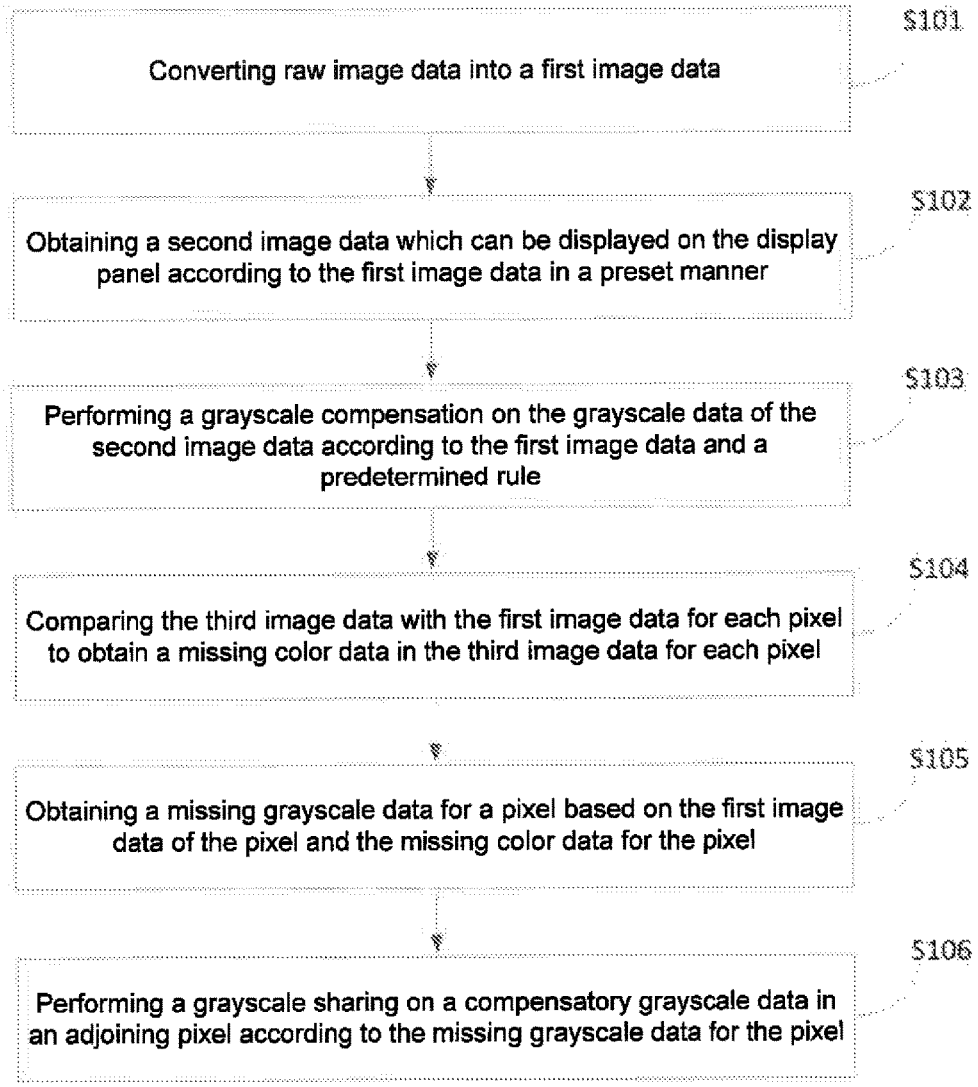
FIG. 7 is a flowchart showing a grayscale compensation method according to a second embodiment of the present invention.

Refer to FIG. 7, which is a flow chart showing a grayscale compensation method according to a second embodiment of the present invention.

This embodiment differs from the first grayscale compensation method as follows:

The method further includes:

S104: Comparing the third image data with the first image data for each pixel to obtain a missing color data in the third image data for each pixel.

According to the first image data and a predetermined rule, the third image data are obtained (the second image data which have been gone through with the grayscale compensation are called a third image data) after the grayscale compensation has been performed on the second image data. The third image data for each pixel includes three-color grayscale data among a second red grayscale data, a green grayscale data, a second blue grayscale data, and a second white grayscale data.

Each of the first image data has a format of red (R), green (G), blue (B), and white (W), for example, formats constituted by multiple sub-pixels of the third image data in an picture may include GBW, RGB, WRG, BWR, so a missing color data in the third image data for each pixel is respectively red (R), white (W), blue (B), and green (G).

S105: Obtaining a missing grayscale data for a pixel based on the first image data of the pixel and the missing color data for the pixel.

Because the missing color data exists in the first image data, when the grayscale compensation is performed at the step S103, the grayscale compensation is also performed on the missing color data at the same time to obtain the missing grayscale data. The missing grayscale data represents the grayscale data of the missing color in the third image data of the pixels, e.g., the blue grayscale data B in WRG.

S106: Performing a grayscale sharing on a compensatory grayscale data in an adjoining pixel according to the missing grayscale data for the pixel.

The compensatory grayscale data represents a grayscale data of a corresponding color with the missing grayscale data. For instance, after the step S103, the arrangement of grayscale data in the third image data of a plurality of pixels is GBW, RGB, WRG, BWR, thus WRG and BWR represent two adjoining pixels. In terms of WRG, the blue grayscale data B is missing, so the compensatory grayscale data is the blue grayscale data B in BWR.

Since a display panel includes a plurality of pixel units, the pixel unit includes a red sub-pixel, a green sub-pixel, a blue sub-pixel, and a white sub-pixel. Binding with an arrangement of the pixel units on the display panel to analyze for each pixel, and it is found that a green grayscale data G is missing in BWR, a red grayscale data R is missing in GBW, a white grayscale data W is missing in RGB, a blue grayscale data B is missing in WRG, thus a grayscale data of a missing color in a current pixel necessarily appear in a succeeding pixel. For example, the missing green grayscale data G in current pixel BWR necessarily appear in the succeeding pixel GBW.

In the following description, a pixel BWR is taken as an example:

It is assumed that an overall arrangement of pixels is represented by WRG BWR GBW, the pixel WRG and the pixel GBW are adjoining pixels of the pixel BWR. Due to lack of a blue grayscale data B in WRG and lack of a red grayscale data R in GBW, the grayscale compensatory data $B''_{WRG}$ (representing the blue grayscale data B in WRG after the grayscale compensation has been performed) and the grayscale compensatory data $B''_{BWR}$ (representing the blue grayscale data B in BWR after the grayscale compensation has been performed) are proportionally mixed to form $B'''_{BWR}$ (representing the blue grayscale data B in BWR after the grayscale sharing has been performed). The data $B'''_{BWR}$ is displayed on a corresponding sub-pixel of a display panel. Similarly, the grayscale compensatory data $R''_{GBW}$ (representing the red grayscale data R in GBW after the grayscale compensation has been performed) and the grayscale compensatory data $R''_{BWR}$ (expressing the red grayscale data R in BWR after the grayscale compensation has been performed) are proportionally mixed to form $R'''_{BWR}$ (representing the red grayscale data R in BWR after the grayscale data sharing has been performed). The data $R'''_{BWR}$ is displayed on a corresponding sub-pixel of a display panel. The data $W''_{BWR}$ represents the white grayscale data in BWR after the grayscale compensation has been performed, and the data $W'''_{BWR}$ represents the white grayscale data in BWR after a grayscale data has been shared.

The final grayscale data which is inputted to the corresponding pixel unit on the display panel can be obtained by the following equations:

$$B'''_{BWR}=B''_{WRG}*x7+B''_{BWR}*x8 \quad \text{equation 25}$$

$$W'''_{BWR}=W''_{BWR} \quad \text{equation 26}$$

$$R'''_{BWR}=R''_{GBW}*x7+R''_{BWR}*x8 \quad \text{equation 27}$$

where x7, x8 are a predetermined proportional coefficients, the foregoing proportional coefficients x1~x8 can be configured according to light parameters of the display panel.

The grayscale compensation are performed on the converted data R', G', B', and W' to obtain the data R", G", B", and W", which are inputted to corresponding sub-pixels on the display panel, and it is noted that one grayscale data among the data R", G", B", and W" is missing for each pixel according to the arrangement of pixel of the panel. Although the grayscale compensation has been performed, the missing data will inevitably affect the image quality. In order to avoid reducing the image quality, a grayscale data sharing is adopted by means of proportionally mixing a grayscale data of a missing color in a current pixel with a grayscale data of the same color in an adjoining pixel and then displaying the mixed grayscale data on the adjoining sub-pixel of the display panel. The image quality can be improved by the grayscale data sharing to mitigate an impact of the missing data.

The grayscale data of the missing color in the pixel is operated with only one grayscale data of the corresponding color in an adjoining pixel for the grayscale data sharing. For example, the blue grayscale data B is missing in WRG, and the operation of grayscale data sharing is operated by sharing with only one blue grayscale data of GBW or RGB, but not simultaneously sharing with both blue grayscale data of GBW and RGB to avoid affecting the hue of the picture.

Preferably, the first white grayscale data is a minimum value among a grayscale data of a raw red, a grayscale data of a raw green, a grayscale data of a raw blue.

The grayscale compensation method of the present invention employs steps of converting an input raw image data, performing a compensation for the discarded pixels following the conversion by using the grayscale data of the remaining pixels, and then performing a grayscale sharing to mitigate an impact of the missing data and improve the image quality.

In summary, while the present invention has been described preferred embodiments, it is understood that the above-described preferred embodiments are not intended to limit the present invention. One of ordinary skill in the art, without departure from the spirit and scope of the invention, can make various kinds of modifications and variations, and the scope of the present invention is to be defined by the claims.

What is claimed is:

1. A grayscale compensation method of a display panel comprising a plurality of pixel units each comprising a red sub-pixel, a green sub-pixel, a blue sub-pixel, and a white sub-pixel, the grayscale compensation method comprising:

converting, using a processor, raw image data, indicative of a digital image, into first image data in each of the pixel units, the raw image data for each of the pixel units comprising a raw red grayscale data, a raw green grayscale data, and a raw blue grayscale data, the first image data for each of the pixel units comprising a first red grayscale data, a first green grayscale data, a first blue grayscale data, and a first white grayscale data;

obtaining second image data displayed on the display panel according to the first image data in a preset manner in each of the pixel units, the second image data for each of the pixel units comprising 3-color grayscale data among a red, a green, a blue, and a white grayscale data of the first image data;

obtaining third image data by performing grayscale compensation, using the processor, on the second image data based on the first image data and a predetermined rule in each of the pixel units, wherein the third image data for each of the pixel units includes 3-color grayscale data among a second red grayscale data, a green grayscale data, a second blue grayscale data, and a second white grayscale data;

comparing, using the processor, the third image data with the first image data for each of the pixel units to obtain missing color data in the third image data for each of the pixel units in each of the pixel units;

obtaining, using the processor, a missing grayscale data for each of the pixel units based on the first image data of each of the pixel units and the missing color data for each of the pixel units in each of the pixel units, wherein the missing grayscale data represents the grayscale data of missing color in the third image data of each of the pixel units; and performing a grayscale sharing, using the processor, on compensatory grayscale data in an adjoining pixel unit according to the missing grayscale data for each of the pixel units, wherein the compensatory grayscale data represents grayscale data of a corresponding color with the missing grayscale data;

displaying the third image, data, indicative of a grayscale compensation image of the digital image, on the display panel;

wherein the step of performing grayscale compensation on the second image data based on the first image data and the predetermined rule in each of the pixel units further comprises:

determining, using the processor, whether the second image data of each of the pixel units includes the white grayscale data in each of the pixel units;

performing the grayscale compensation using the processor, on the second image data of each of the pixel units by using a first predetermined rule when the second image data of each of the pixel units contain the white grayscale data in each of the pixel units;

performing the grayscale compensation using the processor, on the second image data of each of the pixel units by using a second predetermined rule when the second image data of each of the pixel units do not contain the white grayscale data in each of the pixel units;

wherein when the second image data of each of the pixel units contain the white grayscale data, if a first difference value is greater than a second difference value and the first white grayscale data is greater than a preset grayscale value, then the first predetermined rule performs the grayscale compensation using the processor, on the second image data of each of the pixel units based on the first white grayscale data in each of the pixel units;

wherein the first difference value is an absolute value of a difference between the first white grayscale data and the preset grayscale value, the second difference value is an absolute value of a difference between a first setting value and the preset grayscale value; and wherein a first setting value is a minimum among the first red grayscale data, the first green grayscale data, and the first blue grayscale data of the each of the pixel units.

2. The grayscale compensation method according to claim 1, wherein when the second image data of each of the pixel units contain the white grayscale data, if a first difference value is less than a second difference value and the first white grayscale data is greater than a preset grayscale value, then the first predetermined rule performs the grayscale compensation, using the processor, on the second image data of each of the pixel units based on the first white grayscale data in each of the pixel units;

wherein the first difference value is an absolute value of a difference between the first white grayscale data and the preset grayscale value, the second difference value is an absolute value of a difference between a first setting value and the preset grayscale value;

wherein a firsts setting value is a minimum among the first red grayscale data, the first green grayscale data, and the first blue grayscale data of each of the pixel units.

3. The grayscale compensation method according to claim 1, wherein when the second image data of each of the pixel units contain the white grayscale data, if a first difference value is less than a second difference value and the first white grayscale data is less than or equal to a preset grayscale value, then the first predetermined rule performs the grayscale compensation, using the processor, on the second image data of each of the pixel units based on a first setting value in each of the pixel units;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of each of the pixel units.

4. The grayscale compensation method according to claim 1, wherein when the second image data of each of the pixel units do not contain the white grayscale data, if a third difference value is greater than a first difference value and the second setting value is greater than a preset grayscale value, then the second predetermined rule performs the grayscale compensation, using the processor, on the second image data of each of the pixel units based on a second setting value in each of the pixel units;

wherein the first difference value is an absolute value of a difference between the first white grayscale data and the preset grayscale value, the third difference value is an absolute value of a difference between a second setting value and the preset grayscale value;

wherein a second setting value is a maximum among, the first red grayscale data, the first green grayscale data, and the first blue grayscale data of each of the pixel units.

5. The grayscale compensation method according to claim 1, wherein when the second image data of each of the pixel units, do not contain the white grayscale data, if a third difference value is less than a first difference value and the second setting value is less than or equal to a preset grayscale value, then the second predetermined rule is that performing the grayscale compensation on the second image data of each of the pixel units based on a second setting value in each of the pixel units;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of each of the pixel units.

6. The grayscale compensation method according to claim 1, wherein when the second image data of each of the pixel units do not contain the white grayscale data, if a third difference value is greater than a first difference value and the second setting value is less than or equal to a preset grayscale value, then the second predetermined rule performs the grayscale compensation, using the processor, on the second image data of each of the pixel units based on a second setting value in each of the pixel units;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of each of the pixel units.

7. A grayscale compensation method of a display panel comprising a plurality of pixel units each comprising a red sub-pixel, a green sub-pixel, a blue sub-pixel, and a white sub-pixel, the grayscale compensation method comprising:

converting, using a processor, raw image data, indicative of a digital image, into first image data in each of the pixel units, the raw image data for each of the pixel units comprising a raw red grayscale data, a raw green grayscale data, and a raw blue grayscale data, the first image data for each of the pixel units comprising a first red grayscale data, a first green grayscale data, a first blue grayscale data, and a first white grayscale data;

obtaining second image data displayed on the display panel according to the first image data in a preset manner in each of the pixel units, the second image data for each of the pixel units comprising 3-color grayscale data among a red, a green, a blue, and a white grayscale data of the first image data; and performing grayscale compensation using the processor, on the second image data based on the first image data and a predetermined rule in each of the pixel units;

wherein the step of performing grayscale compensation on the second image data based on the first image data and the predetermined rule in each of the pixel units further comprises:

determining, using the processor, whether the second image data of each of the pixel units includes the white grayscale data in each of the pixel units; and performing the grayscale compensation using the processor, on the second image data of each of the pixel units by using a first predetermined rule when the second image data of each of the pixel units contain the white grayscale data in each of the pixel units;

wherein when the second image data of each of the pixel units contain the white grayscale data, if a first difference value is greater than a second difference value and the first white grayscale data is greater than a preset grayscale value, then the first predetermined rule performs the grayscale compensation using the processor, on the second image data of each of the pixel units based on the first white grayscale data in each of the pixel units;

displaying the second image data, indicative of a grayscale compensation image of the digital image, on the display panel;

wherein the first difference value is an absolute value of a difference between the first white grayscale data and the preset grayscale value, the second difference value is an absolute value of a difference between a first setting value and the preset grayscale value; and wherein a first setting value is a minimum among the first red grayscale data, the first green grayscale data, and the first blue grayscale data of each of the pixel units.

8. The grayscale compensation method according to claim 7, wherein the step of performing grayscale compensation on the second image data based on the first image data and the predetermined rule in each of the pixel units further comprises:

performing the grayscale compensation on the second image data of each of the pixel units by using a second predetermined rule in each of the pixel units when the second image data of each of the pixel units do not contain the white grayscale data in each of the pixel units.

9. The grayscale compensation method according to claim 8, wherein when the second image data of each of the pixel units contain the white grayscale data, if a first difference value is less than a second difference value and the first white grayscale data is greater than a preset grayscale value, then the first predetermined rule performs the grayscale compensation using the processor, on the second image data of the based on the first white grayscale data in each of the pixel units;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of each of the pixel units.

10. The grayscale compensation method according to claim 8, wherein when the second image data of each of the pixel units contain the white grayscale data, if a first difference value is less than a second difference value and the first white grayscale data is less than or equal to a preset grayscale value, then the first predetermined rule performs the grayscale compensation using the processor, on the second image data of each of the pixel units based on a first setting value in each of the pixel units;

wherein the first difference value is an absolute value of a difference between the first white grayscale data and the preset grayscale value, the second difference value is an absolute value of a difference between a first setting value and the preset grayscale value;

wherein a first setting value is a minimum among the first red grayscale data, the first green grayscale data, and the first blue grayscale data of each of the pixel units, in each of the pixel units.

11. The grayscale compensation method according to claim 8, wherein when the second image data of each of the pixel units do not contain the white grayscale data, if a third difference value is greater than a first difference value and the second setting value is greater than a preset grayscale value, then, the second predetermined rule performs the grayscale compensation using the processor, on the second image data of each of the pixel units based on a second setting value in each of the pixel units;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of each of the pixel units.

12. The grayscale compensation method according to claim 8, wherein when the second image data of each of the pixel units do not contain the white grayscale data, if a third difference value is less than a first difference value and the second setting value is less than or equal to a preset grayscale value, then the second predetermined rule performs the grayscale compensation using the processor, on the second image data of each of the pixel units based on a second setting value in each of the pixel units;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of each of the pixel, units.

13. The grayscale compensation method according to claim 8, wherein when the second image data of each of the pixel units do not contain the white grayscale data, if a third difference value is greater than a first difference value and the second setting value is less than or equal to a preset grayscale value, then the second predetermined rule performs the grayscale compensation using the processor, on the second image data of each, of the pixel units based on a second setting value in each of the pixel units;

wherein the first difference value is an absolute value of a difference between the first white grayscale data and the preset grayscale value, the third difference value is an absolute value of a difference between a second setting value and the preset grayscale value;

wherein a second setting value is a maximum among the first red grayscale data, the first green grayscale data, and the first blue grayscale data of each of the pixel units.

14. The grayscale compensation method according to claim 7, wherein the third image data are obtained after the grayscale compensation has been performed on the second image data based on the first image data and a predetermined rule in each of the pixel units, the third image data for each of the pixel units comprises three-color grayscale data among a second red grayscale data, a green grayscale data, a second blue grayscale data, and a second white grayscale data;

the method further comprising:

comparing, using the processor, the third image data with the first image data for each of the pixel units to obtain missing color data in the third image data for each of the pixel units in each of the pixel units;

obtaining, using the processor, a missing grayscale data for a pixel based on the first image data of the pixel and the missing color data for each of the pixel units in each of the pixel units, wherein the missing grayscale data represents the grayscale data of a missing color in the third image data of each of the pixel units;

performing a grayscale sharing using the processor, on compensatory grayscale data in an adjoining pixel unit according to the missing grayscale data for each of the pixel units in each of the pixel units, wherein the compensatory grayscale data represents grayscale data of a corresponding color with the missing grayscale data.

* * * * *